US006714182B2

(12) United States Patent
Hong

(10) Patent No.: US 6,714,182 B2
(45) Date of Patent: Mar. 30, 2004

(54) METHOD AND SYSTEM OF COMPENSATING KICKBACK VOLTAGE FOR A LIQUID CRYSTAL DISPLAY DEVICE

(75) Inventor: Jin-Cheol Hong, Kumi-shi (KR)

(73) Assignee: LG Philips LCD Co., Ltd., Seoul (KR)

( * ) Notice: Subject to any disclaimer, the term of this patent is extended or adjusted under 35 U.S.C. 154(b) by 346 days.

(21) Appl. No.: 09/750,245

(22) Filed: Dec. 29, 2000

(65) Prior Publication Data

US 2001/0011984 A1 Aug. 9, 2001

(51) Int. Cl.[7] ..... G09G 3/36
(52) U.S. Cl. ..... 345/95; 345/87
(58) Field of Search ..... 345/87, 89, 90, 345/92, 93, 94, 95, 98, 208, 210, 211; 349/125, 126, 139, 141, 143, 149

(56) References Cited

U.S. PATENT DOCUMENTS 6,049,368 A * 4/2000 Song ..... 349/139
6,341,003 B1 * 1/2002 Ashizawa et al. ..... 349/141
6,392,626 B1 * 5/2002 Moon ..... 345/92

* cited by examiner

*Primary Examiner*—Vijay Shankar
(74) *Attorney, Agent, or Firm*—McKenna Long & Aldridge LLP

(57) ABSTRACT

A system for compensating for a kickback voltage for a common electrode of a LCD device having a gate line where the gate signal is applied from a first end to a second. The system includes a mechanism configured to apply a constant current to the common electrode at a location corresponding to the first end of the gate line, and mechanism configured to apply a common voltage to the common electrode at a location corresponding to the second end of the gate line. The constant current applied to the common electrode helps to maintain the difference of the common voltages between the positions corresponding to first and second ends of the gate line.

22 Claims, 4 Drawing Sheets

METHOD AND SYSTEM OF COMPENSATING KICKBACK VOLTAGE FOR A LIQUID CRYSTAL DISPLAY DEVICE

This application is based on Korean Application No. 1999-26941, which was filed on Jul. 5, 1999, which is hereby incorporated by reference.

BACKGROUND OF THE INVENTION

1. Field of the Invention

The present invention relates to an active-matrix liquid crystal display (LCD) device and associated panel, and a method of applying a common voltage to the LCD device.

2. Discussion of the Related Art

An active matrix type LCD device, employing a thin film transistor (TFT) as a switching device, is typically made up of two array substrates with a liquid crystal material interposed. The TFT includes gate, source, and drain electrodes. The lower substrate includes a gate line applying gate signals to the gate electrode, a data line applying data signals to the source electrode, and an insulation layer interposed therebetween. The device further includes a pixel electrode contacting the drain electrode on each pixel region defined by the gate and data lines. Each pixel includes the pixel electrode and the common electrode and the interposed liquid crystal layer. A portion of the pixel electrode, a portion of the gate line and the interposed insulation layer form a storage capacitor.

The upper substrate includes a common electrode having a transparent material. The color filter can be included in the upper substrate for color display between the substrate and the common electrode.

A liquid crystal display panel is completed by injecting the liquid crystal between the two substrates and sealed by the sealant. The panel is accompanied with the driving circuits for the gate and data lines. The scanning signals transmitted to the gate line control the magnitude of the data signal transmitted to the liquid crystal material, which can be divided into various levels, leading to diverse gray levels of the display device.

Since the TFT LCD device has many electrodes or lines in a matrix form, a parasitic resistance and a parasitic capacitance exist essentially in the device and they change the gate and data signals from the driving integrated circuit depending on the position.

The On-current required to drive the liquid crystal is defined by the current necessary to charge the pixel within the gate access time, which is represented by the following equation (1).

$$I_{on}=C_{tot}\times dV_p(t)/dt \quad (1)$$

wherein $C_{tot}$=Clc+Cst+Cgs, $V_p(t)$ is voltage applied to the pixel, and $I_{on}$=Vd/Ron, and wherein Clc is a pixel capacitance, Cst is a storage capacitance connected in parallel to the pixel capacitance, and Cgs is a parasitic capacitance between the gate electrode and the source electrode, and Ron is resistance of the liquid crystal when the gate signal is ON.

The voltage required to drive a pixel can be expressed the following equation (2).

$$V_p(t)=Vd\times[1-\mathrm{EXP}(-t2/\{\mathrm{Ron}\times Ctot\})] \quad (2)$$

wherein Vd is a data signal voltage.

The pixel voltage ($V_p(t)$) is charged to the pixel and to the storage capacitor connected in parallel to the pixel. Then the signal voltage is applied to the liquid crystal and the storage capacitor through the source and drain electrodes of the TFT when the gate voltage is applied to the gate electrode. At this time, the signal is maintained until the next gate signal, even though the gate voltage is off.

However, due to the parasitic capacitance occurring between the gate and source electrodes, the pixel voltage is shifted by ΔVp, which is referred to as a kickback voltage. The kickback voltage is represented by the following equation (3).

$$\Delta Vp=Cgs/(Cgs+Clc+Cst)\times\Delta Vg \quad (3)$$

wherein ΔVg is the gap between the gate electrode voltage high and low.

In order to provide the display, alternate currents are applied to the liquid crystal, the direct current elements remain due to the asymmetry of the polarity because of the kickback voltage, which causes bad display characteristics such as flicker or a residual display. The kickback voltage "ΔVp" depends on the capacitor and the gate voltage and varies according to the RC delay of the gate signal. The flicker caused by the kickback voltage has a distribution according to the position.

FIG. 1A shows a liquid crystal display panel using a dot inversion driving method, which means a driving method in which pixels adjacent to each other in the two-dimensional array of liquid crystal cells (pixels) alternately become positive or negative in polarity. DC voltage is generally used for the common voltage. The DC voltage from a common voltage supply circuit 11 is applied to the lower panel or array substrate (not shown). Since the common voltage connection 15 for the lower and upper panels are arranged uniformly in the two dimensional array in order to supply the same voltage to the common electrodes of the upper panel or color filter substrate 13, the common voltages at both sides of the panel have the same value as each other.

FIG. 1B is an equivalent circuit of FIG. 1A. Since the common voltages from the common voltage supply circuit 11 are supplied to the panel uniformly, the voltages V1 and V2 applied to both ends of the upper substrate have the same value as each other.

Meanwhile, the circuit illustrated in FIG. 1B inevitably causes flicker due to the difference of the optimum common voltages according to the position in the liquid crystal panel.

The gate driving IC supplies gate-driving voltage to the gate electrode through the gate line. Since the gate signal is affected by the resistance of the gate line and the parasitic capacitance, it is deflected when it arrives at the end of the gate line. At that point, the data signal is lowered by that amount, causing the kickback voltage to be reduced. Further, since the signal voltage is not sufficiently applied to the liquid crystal, the desirable brightness of the display is not obtained.

In order to compensate for the deviation of the kickback voltage, a method of differentiating the common voltage is proposed. The method is explained with reference to FIGS. 2A and 2B.

FIG. 2A is a plan view illustrating a liquid crystal panel 22 having a lower panel or array substrate and an upper panel or color filter substrate. The array substrate has thin film transistors each having gate, source, and drain electrodes. The lower panel further includes pixel electrodes connected to the drain electrode of the thin film transistor. The gate electrode is connected to the gate line and the source electrode is connected to the data line. The gate line is connected to the gate driving IC 27 and the data line is connected to the data driving IC (not shown) via a TCP (Tape Carrier Package). The upper panel has a common electrode corresponding to the pixel electrode of the lower panel.

As shown in FIG. 2A, two different supply circuits 23 and 25 apply the different common voltages "Vcom2" and "Vcom1" to left and right sides of the panel 22, respectively.

FIG. 2B is an equivalent circuit of FIG. 2A. Since the common voltages are supplied from independent power supplies, the applied voltages V1 and V2 applied to both sides of the common electrode 20 are different. Thus, the flicker can be reduced using the method of applying different common voltages at both ends of the gate lines.

Meanwhile when determining the optimum common voltages applied to each side of the panel according to the method shown in FIGS. 2A and 2B IC, the contact resistance error between the common electrode having ITO (Indium Tin Oxide) and the common electrode driving terminal which transmits the common voltage from the common voltage supply. The contact resistance can be varied depending on the model of the panel or on the manufacturing error, which should be regarded when determining the optimum common voltage in order to reduce the flicker.

SUMMARY OF THE INVENTION

Accordingly, the present invention is directed to a method of compensating kickback voltage for a liquid crystal display device that substantially obviates one or more of the problems due to limitations and disadvantages of the related art.

An object of the present invention is to provide a method for compensating kickback voltage which is not influenced by the contact resistance between the common electrode and the common electrode driving terminal in order to reduce the flicker or the residual display.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides an active matrix type liquid crystal display (LCD) device, comprising: a first substrate including a plurality of pixel electrodes arranged in matrix form, a plurality of thin film transistors having a gate electrode and a source electrode, a plurality of data lines transmitting data signals to the source electrode, and a plurality of gate lines transmitting gate signals to the gate electrode from a first end to a second end thereof; a second substrate opposing to the first substrate, the second substrate having a common electrode facing the plurality of pixel electrodes of the first substrate; a liquid crystal layer between the first and second substrates; a gate line driving circuit transmitting gate signals to the first ends of the plurality of gate lines; a data line driving circuit transmitting data signals to the plurality of gate lines; a common voltage supply for applying a common voltage to a first position of the common electrode corresponding to the second end of one gate line, the first position having a first contact resistance; a constant current source for supplying a constant current to a second position of the common electrode corresponding to the first end of one gate line, the second position having a second contact resistance; first and second connection points between the first and second substrates, respectively, through the first and second connection points the common voltage and the constant current being transmitted to the second substrate from the first substrate; and wherein the first contact resistance is between the first position of the common electrode and the first connection point, and wherein the second contact resistance is between the second position of the common electrode and the second connection point.

The first and second connection points include a silver paste. The common voltage is supplied to the first connection point through a common voltage transmitting terminal.

The device further includes a data tape carrier package through which the data signals are transmitted to the plurality of data lines from the data driving circuit and the common voltage from the common voltage supply is transmitted to the common voltage transmitting terminal.

The constant current is supplied to the second connection point through a constant current transmitting terminal.

The common voltage and constant current transmitting terminals include Chrome, Molybdenum, Tantalum or silver.

The device includes a plurality of gate tape carrier packages through which the gate signals are transmitted to the plurality of gate lines from the gate driving circuit and the constant current from the constant current source is transmitted to the constant current transmitting terminal.

The constant current is transmitted to the constant current transmitting terminal through two gate tape carrier packages, which are positioned at opposing ends corresponding to the first end of the gate line.

The constant current source further comprises an amplifier such as a transistor that can adjust the constant current thereof depending on the value of the common voltage of the common voltage supply.

In an another aspect of the invention, the present invention provides a method of adjusting a common voltage for an active matrix liquid crystal display device. The liquid crystal display device includes a first substrate including a plurality of pixel electrodes arranged in matrix form, a plurality of thin film transistors having a gate electrode and a source electrode, a plurality of data lines transmitting data signals to the source electrode, and a plurality of gate lines transmitting gate signals to the gate electrode from a first end to a second end thereof; a second substrate opposing to the first substrate, the second substrate having a common electrode facing the plurality of pixel electrodes of the first substrate; a liquid crystal layer between the first and second substrates; a gate line driving circuit transmitting gate signals to the first ends of the plurality of gate lines; and a data line driving circuit transmitting data signals to the plurality of gate lines.

The method comprises applying a common voltage to the common electrode through a first connection point having a first contact resistance at a corresponding position of the second end of the plurality of gate lines; and applying a constant current to the common electrode through a second connection point having a second contact resistance at a corresponding position of the first end of the plurality of gate lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 3A:
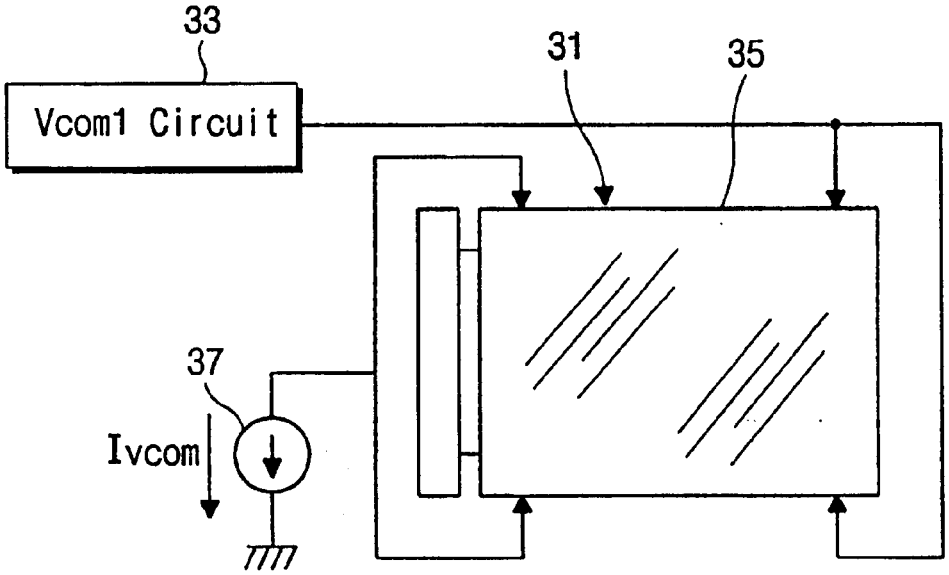
FIGS. 3A and 3B are a schematic plan view of a liquid crystal panel and an equivalent circuit diagram, respectively, and illustrate a method of applying a common voltage to the panel according to an embodiment of the invention.

As shown in FIG. 3A, the common voltage is supplied from a common voltage supply 33 to the right side of the panel 31. To the left side of the panel 31 (upper substrate 35) a constant current source 37 supplies a constant current "Ivcom." As shown in FIG. 3B, a schematic equivalent circuit of FIG. 3A, the gap of the common voltages "V1" and "V2" applied to the both sides can be maintained with the constant current source 37 and the constant resistance of the common electrode 34.

Figure 3B:
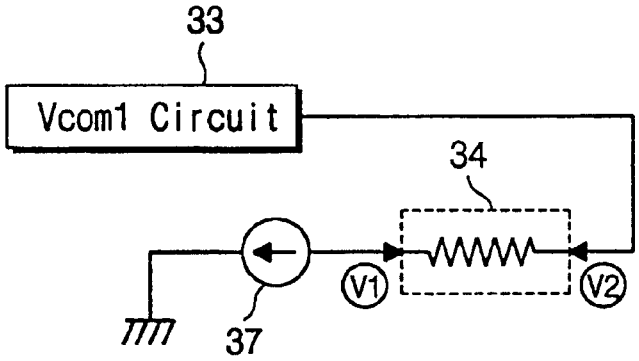
Figure 4:
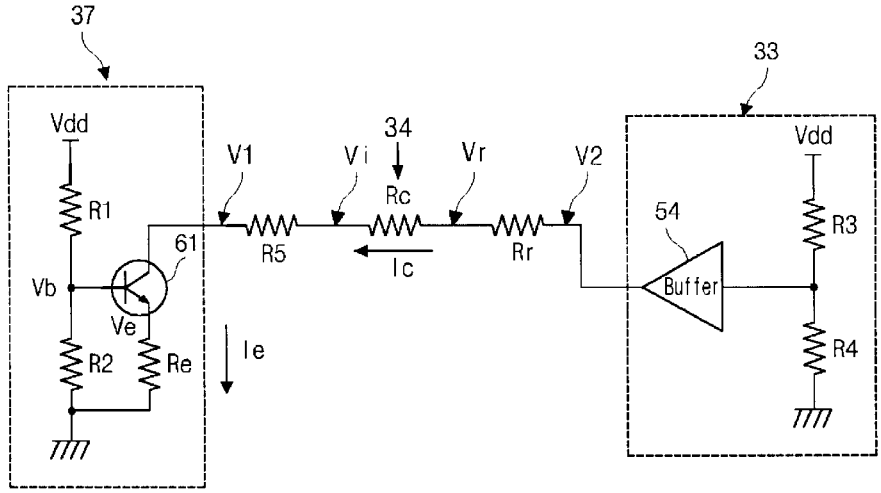
FIG. 4 is a detailed equivalent circuit diagram illustrating a constant current source and a common voltage supply according to an embodiment of the invention.

Referring to FIG. 4, a more detailed circuit diagram of FIG. 3B, to a first side of the common electrode the constant current source 37 is connected, and to a second side of the common electrode the common voltage supply 33 is connected. Between the common electrode having a resistance "Rc" and the constant current source 37 lies a first contact resistance "R5", and between the resistance "Rc" and the common voltage supply 33 lies a second contact resistance "Rr."

The common voltage supply 33 is a general direct current (DC) source and can include a variable resistance (not shown) in order to adjust common voltage for each panel model. The buffer 54 beneficially helps to stabilize the supply of the common voltage.

The constant current source 37 has a voltage source "Vdd", resistances "R1", "R2" and "Re", and a transistor 61 having an emitter, a base, and a collector. The transistor 61 is connected to those resistances and the first contact resistance "R5" and can be substituted with an operational amplifier (OP AMP).

The base voltage of the transistor can be calculated by the following equation (4).

$$Vb=(Vdd\times R2)/(R1+R2)$$

The emitter voltage "Ve" is about Vb-0.6 V(Volts), and the emitter current "Ie" is determined by Ve/Re. Wherein 0.6V is defined constant by the general transistor. Since the collector current "Ic" is similar to the emitter current "Ie", the current "Ic" flowing in the common electrode 34 can be controlled by adjusting the resistances "R1", "R2" and "Re". In that case, each voltage value at the connection positions between the common voltage supply 33 and the constant current source 37 can be calculated by the following equations (5), (6), (7) and (8).

$$V2=(Vdd\times R4)/(R3+R4) \quad (5)$$

$$Vr=V2-(Ic\times Rr) \quad (6)$$

$$Vi=Vr-(Ic\times Rc) \quad (7)$$

$$V1=Vi-(Ic\times R5) \quad (8)$$

At this point, when the first and second contact resistances "R5" and "Rr" are changed due to a manufacturing error, the difference of the voltages applied to both ends of the common electrode 34 i.e. Vr−Vi is determined by Ic×Rc. Thus, if the collector current "Ic" and the resistance "Rc" of the common electrode 34 are constant, the difference or gap between the voltages applied to both sides of the common electrode 34 can have a constant value. The voltage difference can be controlled by the current of the constant current source 37. The constant current "Ic" is supplied from the position that the gate driving voltage is first applied, i.e. the position of the gate driving IC. And the common voltage is supplied from the position of the end portion of the gate line. Due to the delay or deflection of the gate signal, the common voltage at the end of the gate line should be higher than that at the start point or gate pad of the gate line.

Figure 1A:
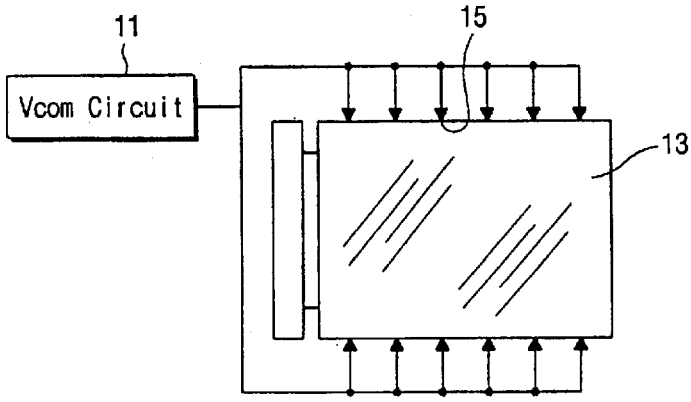
Fig.1A (Related Art)
FIGS. 1A and 1B are a schematic plan view of a liquid crystal panel and an equivalent circuit diagram, respectively, and illustrate a conventional method of applying a common voltage to the panel.
Figure 1B:
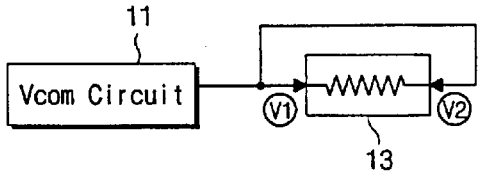
Fig.1B (Related Art)
Figure 2A:
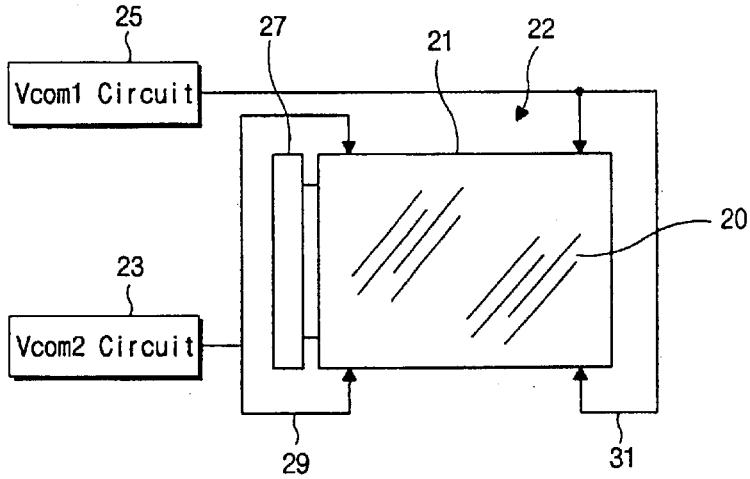
Fig.2A (Related Art)
FIGS. 2A and 2B are a schematic plan view of a liquid crystal panel and an equivalent circuit diagram, respectively, and illustrate another conventional method of applying a common voltage to the panel.
Figure 2B:
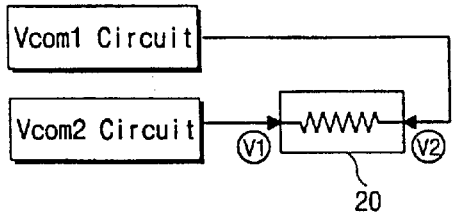
Fig.2B (Related Art)
Figure 5:
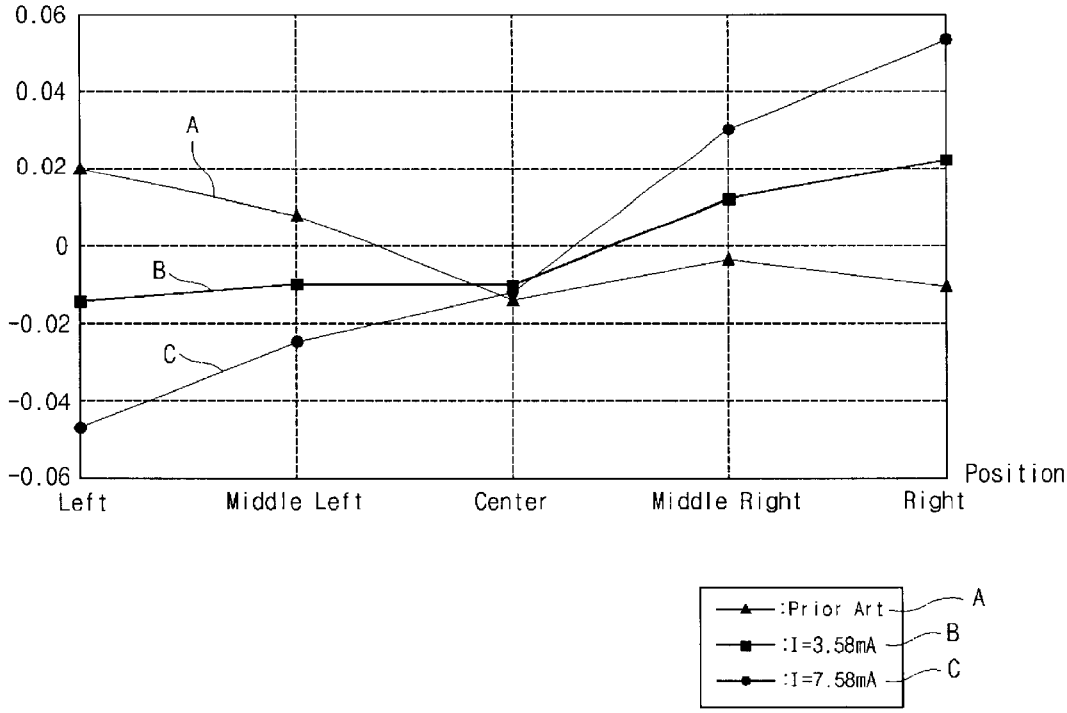
FIG. 5 is a graph illustrating an average deviation of the common voltages with respect to the positions in the panel in order to compare the conventional method and the inventive method.

FIG. 5 is a graph illustrating an average value of the common voltage in order to compare the conventional method and the inventive method. The graph is obtained by measuring the average difference between the real common voltage and the optimum common voltage that can reduce the flicker at various positions in the panel. In the panel, the gate signal is assumed to flow from the left to the right. Thus, the result of the graph is better when the value approaches 0 (zero) Volt. "A" line of the graph is obtained when using the method of FIGS. 2A and 2B. "B" and "C" lines are obtained using the inventive method while varying the constant current of the constant current source. The "C" line is obtained when the constant current is 7.58 mA, and the "B" line is obtained when the constant current is 3.58 mA. The graph shows that the compensation is not desirable when using the conventional method and that the compensation can be adjusted by optimizing the constant current.

Figure 6:
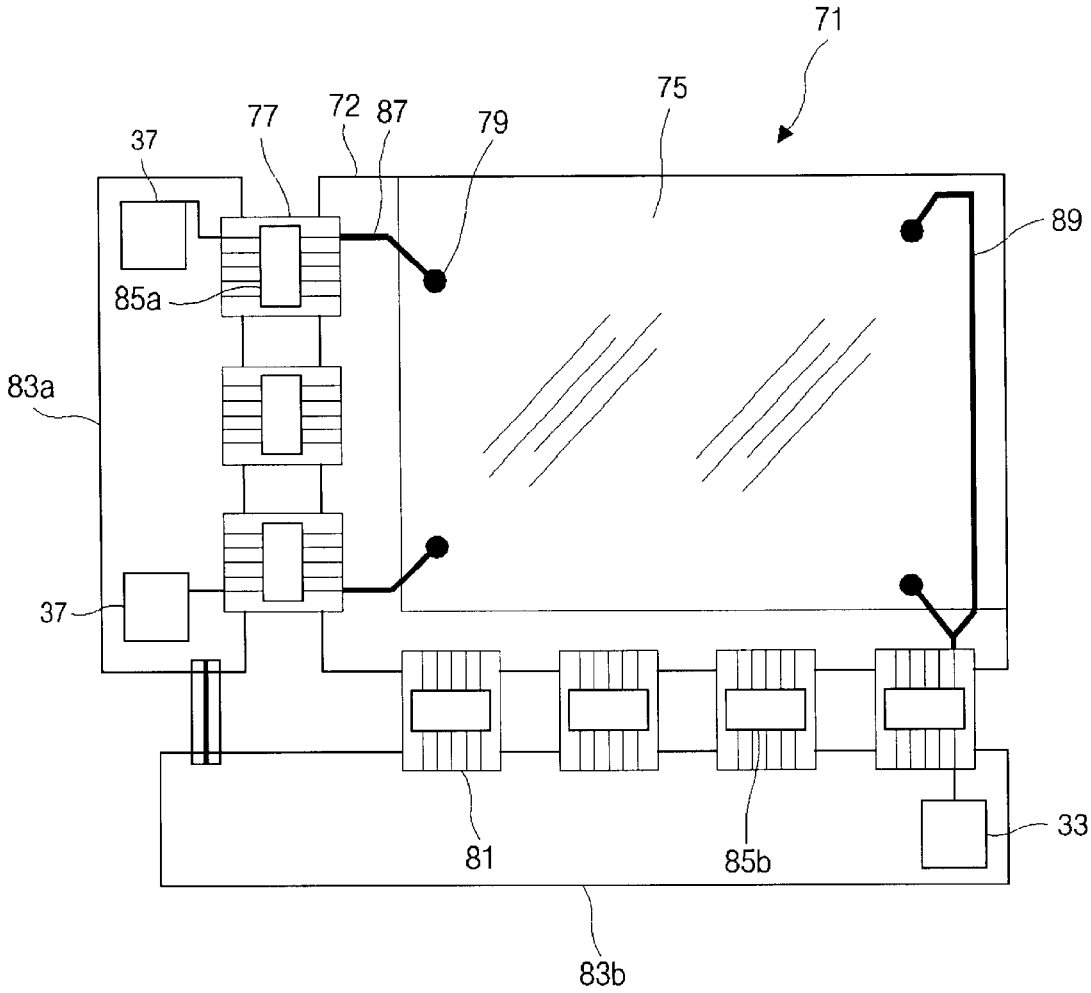
FIG. 6 is a plan view illustrating a liquid crystal display panel having the common voltage supply and the constant current source according to an embodiment of the invention.

FIG. 6 is a schematic plan view illustrating a structure of a liquid crystal display panel according to an embodiment of the invention. The liquid crystal display panel 71 includes an upper substrate 75 having a common electrode 34 (see FIG. 4), a lower substrate 72 having gate and data lines in matrix form, and first and second printed circuit boards 83*a* and 83*b* connected to the lower substrate 72 via TCPs 77 and 81. The first printed circuit board 83*a* has a constant current source 37 for supplying constant current to the common electrode of the upper substrate 75. The second printed circuit board 83*b* has a common voltage supply 33 for supplying voltage to the common electrode of the upper substrate 75. The constant current and the common voltage are first supplied to terminals 87 and 89, respectively, of the lower substrate 72 via the TCPS 77 and 81, which have gate driving ICs 85*a* and data driving IC 85*b*, respectively. Though not shown exactly in this Figure, the common voltage is applied at the end of the gate line opposite to the gate driving IC, and the constant current is applied at the start point of the gate line or at position of the gate pad, as explained before. Those terminals 87 and 89 are formed by patterning and are made of molybdenum, tantalum, silver, etc.

The common voltage and the constant current supplied to the terminals 87 and 89, respectively, are applied to the common electrode 34 of the upper substrate 75 through a connection point 79, which is beneficially Silver (Ag) paste, which can help combine the upper and lower substrates 75 and 72.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An active matrix type liquid crystal display (LCD) system, comprising:

a first substrate including a plurality of pixel electrodes arranged in matrix form, a plurality of thin film transistors each having a gate electrode and a source electrode, a plurality of data lines transmitting data signals to the source electrodes, and a plurality of gate lines transmitting gate signals to the gate electrodes from a first end to a second end of each gate line;

a second substrate opposing to the first substrate, the second substrate having a common electrode facing the plurality of pixel electrodes of the first substrate;

a liquid crystal layer between the first and second substrates;

a gate line driving circuit transmitting the gate signals to first ends of the plurality of gate lines;

a data line driving circuit transmitting the data signals to the plurality of data lines;

a constant current source for supplying a constant current to a first side of the common electrode corresponding to one of the first ends of the gate lines, the first side having a first contact resistance;

a common voltage supply for applying a common voltage to a second side of the common electrode corresponding to the second end of the one gate line, the second side having a second contact resistance;

first and second connection points between the first and second substrates, respectively, through the first and second connection points the constant current and the common voltage being transmitted to the second substrate from the first substrate; and wherein the first contact resistance is between the first side of the common electrode and the first connection point, and wherein the second contact resistance is between the second side of the common electrode and the second connection point.

2. A system according to claim 1, wherein the first and second connection points include a silver paste.

3. A system according to claim 1, wherein the common voltage is supplied to the second connection point through a common voltage transmitting terminal.

4. A system according to claim 3, wherein the common voltage transmitting terminal includes one selected from the group consisting of Chrome, Molybdenum, Tantalum and silver.

5. A system according to claim 3, further including a data tape carrier package through which the data signals are transmitted to the plurality of data lines from the data line driving circuit, and the common voltage from the common voltage supply is transmitted to the common voltage transmitting terminal.

6. A system according to claim 1, wherein the constant current is supplied to the first connection point through a constant current transmitting terminal.

7. A system according to claim 6, wherein the constant current transmitting terminal includes one selected from the group consisting of Chrome, Molybdenum, Tantalum and silver.

8. A system according to claim 6, further including a plurality of gate tape carrier packages through which the gate signals are transmitted to the plurality of gate lines from the gate line driving circuit and the constant current from the constant current source is transmitted to the constant current transmitting terminal.

9. A system according to claim 8, wherein the constant current is transmitted to the constant current transmitting terminal through two gate tape carrier packages.

10. A system according to claim 9, wherein the two tape carrier packages are positioned at opposing ends corresponding to the first ends of the gate line.

11. A system according to claim 1, wherein a current through the common electrode is (Vr-Vi)/Rc, and wherein Vr is a voltage of the common voltage after passing across the first contact resistance, Vi is a voltage of the common voltage after passing across the first contact resistance and the common electrode, and wherein Rc is a resistance of the common electrode.

12. A system according to claim 1, wherein the constant current source further comprises an amplifier that can adjust the constant current thereof depending on a value of the common voltage of the common voltage supply.

13. A system according to claim 12, wherein the amplifier includes a transistor.

14. A liquid crystal display (LCD) device, comprising:

a first substrate including a plurality of thin film transistors each having, a gate electrode, a source electrode, and a drain electrode, and a plurality of pixel electrodes each connected to a corresponding drain electrode, a plurality of data lines transmitting data signals to a corresponding source electrode, and a plurality of gate lines transmitting gate signals to a corresponding the gate electrode;

a second substrate opposing to the first substrate, the second substrate having a common electrode facing the plurality of pixel electrodes of the first substrate; and a liquid crystal layer between the first and second substrates;

wherein a constant current is applied to a first side of the common electrode, and wherein a common voltage is applied to a second side of the common electrode.

15. An LCD device according to claim 14, wherein the first side of the common electrode corresponds to a first end of the common electrode, and wherein the second side of the common electrode corresponds to a second end of the common electrode opposite the first end.

16. An LCD device according to claim 14, wherein the first side corresponds to one of the first ends of the plurality of gate lines, and wherein the second side corresponds to second ends of the plurality of gate lines.

17. A liquid crystal display (LCD) panel, comprising:

a first substrate including a plurality of thin film transistors each having, a gate electrode, a source electrode, and a drain electrode, and a plurality of pixel electrodes each connected to a corresponding drain electrodes, a plurality of data lines transmitting data signals to a corresponding source electrode, and a plurality of gate lines transmitting gate signals to the a corresponding gate electrode;

a second substrate opposing to the first substrate, the second substrate having a common electrode facing the plurality of pixel electrodes of the first substrate;

a liquid crystal layer between the first and second substrates;

a constant current source for applying a constant current to a first side of the common electrode; and a common voltage supply for applying a common voltage to a second side of the common electrode.

18. An LCD panel according to claim 17, further comprising a gate driver, wherein the gate driver is connected to first ends of the gate lines.

19. An LCD panel according to claim 17, further comprising:

a first circuit board having the constant current source; and a first tape carrier package connected between the first circuit board and the common electrode for applying the constant current to the common electrode.

20. An LCD panel according to claim 19, further comprising a gate driver, wherein the gate signals are transmitted from the gate driver to the gate lines through the first tape carrier package.

21. An LCD panel according to claim 19, further comprising:

a second circuit board having the common voltage supply; and a second tape carrier package connected between the second circuit board and the common electrode for applying the common voltage to the common electrode.

22. An LCD panel according to claim 21, further comprising a data driver, wherein the data signals are transmitted from the data driver to the data lines through the second tape carrier package.

* * * * *